US006010109A

United States Patent [19]

Green

[11] Patent Number: 6,010,109

[45] Date of Patent: Jan. 4, 2000

[54] SELF RETAINING TOWEL AND METHOD OF RETAINING A TOWEL TO A GOLF BAG

[76] Inventor: Steve Green, P.O. Box 541, Leoti, Kans. 67861

[21] Appl. No.: 09/078,306

[22] Filed: May 13, 1998

[51] Int. Cl.[7] ..... A47G 29/00; A47K 7/02

[52] U.S. Cl. ..... 248/694; 15/209.1; 15/210.1

[58] Field of Search ..... 15/208, 209.1, 15/210.1; 2/48, 50, 91; 248/694

[56] References Cited

U.S. PATENT DOCUMENTS

| | | | |
|---|---|---|---|
| D. 317,693 | 6/1991 | Jencks et al. . | |
| D. 330,140 | 10/1992 | Lerner | D6/608 |
| D. 339,496 | 9/1993 | Corcoran . | |
| D. 363,404 | 10/1995 | Cute . | |
| 2,093,483 | 9/1937 | Sackett | 2/50 |
| 2,308,449 | 1/1943 | Katzman et al. | 2/91 |
| 2,698,944 | 1/1955 | Younghusband . | |
| 3,629,865 | 12/1971 | Weiner . | |
| 3,660,861 | 5/1972 | Delmonico . | |
| 3,857,116 | 12/1974 | Meeker . | |
| 4,404,688 | 9/1983 | Knight . | |
| 4,516,616 | 5/1985 | Fesler . | |
| 4,625,862 | 12/1986 | Clayton . | |
| 4,710,980 | 12/1987 | Brison et al. | 2/50 |
| 5,075,918 | 12/1991 | Zeltner et al. | 15/210 R |
| 5,147,703 | 9/1992 | Provost et al. . | |
| 5,394,914 | 3/1995 | Meek . | |

FOREIGN PATENT DOCUMENTS

| | | |
|---|---|---|
| 207139 | 12/1939 | Switzerland . |

*Primary Examiner*—Derek J. Berger
*Assistant Examiner*—David Heisey
*Attorney, Agent, or Firm*—John R. Ley

[57] ABSTRACT

A towel is formed by a sheet of absorbent material having two panels connected by a bridge. Each of the panels has a shoulder opposite a separation extending from the bridge. The bridge is positioned through the carrying handle to suspend a substantial majority of the panels below the carrying handle with the shoulder of each panel contacting an opposite side of the carrying handle. The shoulders and the suspended substantial majority of the panels located on opposite sides of the handle resist removal of the towel from either direction from within the handle. The separation is formed by slitting the golf towel into its middle region to define the oppositely facing retaining shoulders.

31 Claims, 3 Drawing Sheets

SELF RETAINING TOWEL AND METHOD OF RETAINING A TOWEL TO A GOLF BAG

This invention relates to towels, and specifically towels used in the sport of golfing. More particularly, the present invention relates to a towel that can be supported within a golf-bag handle and remain relatively secured within the handle without requiring auxiliary mechanical connection devices when the golf bag is moved about during a golf game.

BACKGROUND

Towels have become important tools for golfers to carry during the play of the game of golf. Often the golf course grass is wet from the morning dew, a recent rainfall or simply as a result of the watering process. The wet grass causes the golf club heads to become wet after each golf shot. Consequently, many golfers carry a towel to dry the club head before replacing the club in the bag to both protect the club head and the bag and to ensure that the club will be dry the next time it is used. A rather large towel is preferred given the frequency of use.

Additionally, many golfers use their golf towel to clean their club heads while playing. The nature of golf often causes the golfer to strike at the ball and simultaneously dig a divot into the ground. Digging a divot generally causes the club head to become dirty with grass stains, dirt, mud, sand and the like. The dirt, mud or sand becomes wedged in lateral grooves formed in the club face. The lateral grooves are formed in the face of the club head for better contact between the club face and the ball. If the club head is not cleaned, the club loses the benefit of the control offered by the grooves, possibly causing errant shots. The towel is often used to remove any foreign substances from the club face grooves prior to using the club. Some golf courses even provide buckets of water enabling golfers to wet their golf towels and thus aid in the club cleaning process.

Also, at times the golf balls become wet and/or muddy and need to be dried and cleaned. This poses a particular problem on the putting green where a wet or muddy golf ball may not roll as true as a dry, clean ball. For this reason, many golfers take their golf towels with them to the putting green to clean their ball before putting.

Moreover, on rainy days, golfers often use a towel to dry their hands before making a shot. Similarly, many golfers use their towels to remove perspiration on their hands and face throughout a game of golf.

The typical towel used in golf is intended to be mechanically attached to the golf bag. Attaching the towel to the golf bag, as opposed to placing the towel in one of the golf-bag pockets, provides the benefit of having the towel readily available between each shot. Most attachable golf towels have a hole and metal grommet in one end of the towel through which a clip, tie or other mechanical device can be inserted to attach the towel to the bag. Unfortunately, the attaching devices can be inconvenient to manipulate, especially for less dexterous golfers. This poses a significant problem when the towel is removed from the bag, which may occur frequently during a single game of golf. For example, since golf carts and bags are not allowed on putting greens, golfers frequently must remove their towels from their bags to take their towels with them while putting. The use of mechanical devices in attaching a golf towel to the golf bag makes it difficult to continually attach and detach the towel many times while playing a game.

Another drawback associated with attaching the towel to the golf bag with a grommet at one end of the towel is that the size of the towel is limited. As the golf bag is being carried, the attached towel hangs down from the bag. A larger towel may hang down so far that it is longer than the bag, and in such circumstances, the towel may contact and drag along the ground. On particularly wet days, when a larger towel is preferred, dragging the towel usually causes it to become prematurely soaked by the wet grass. Therefore a smaller and sometimes inadequately sized towel may be required to avoid these problems.

The alternative to mechanically connecting the towel to the bag involves draping the towel through the golf-bag hand grip or handle. The benefit of inserting the towel through the handle is that no mechanical devices need be manipulated when retaining the towel to the bag or removing it. No special towels need to be purchased and no mechanical attachment devices need be used. Additionally, a larger towel can be carried since only a portion (usually about half) of the towel's overall length hangs down from the point where the towel extends through the handle.

However, the draped towel is not secure and has a tendency to fall out, especially when the golf bag is being constantly moved and jostled when carrying the bag. During a golf game, the golf bag will be laid down and picked up many times. Each such movement, as well as the typical swaying and bouncing movement from walking while carrying the bag, tends to dislodge the towel from the handle.

Additionally, draping the towel through the handle increases the probability that the towel will rub against the walking golfer. Rubbing against the golfer increases the chances that the towel will work out of the handle and fall from the golf bag. Typically, the golf bag has a separate shoulder strap apart from the lifting handle. However, the shoulder strap typically runs from the top of the golf bag to a position near the middle of the golf bag on the same side as the handle. As the golf bag is carried by the shoulder strap, its near proximity to the handle often causes the towel to rub against the golfer's body. The constant moving and rubbing of the towel against the golfer's body increases the possibility that the towel will fall out of the handle.

Draped towels even fall out of handles of golf bags which are secured to golf carts. The movement of the golf cart causes vibration and bouncing which can cause the unsecured golf towel to work its way free from the handle. The speed of the moving golf cart may be enough to cause a fluttering of the towel which may also inadvertently dislodge the towel.

Moreover, and perhaps most importantly, draping a towel through the carrying handle consumes a large amount of the space between the handle and the golf bag. Grasping the golf bag by the handle can become difficult or complicated when the towel consumes most of the space within the handle. Indeed, grasping the handle may become impossible if a large towel is placed through the handle. This is a significant problem for golfers who carry their clubs, because the handle is used to pick up and lift the bag, typically after each shot. Even if the golf bag has a shoulder strap for carrying the bag, the handle still provides the best means of lifting the bag.

It is with respect to these and other considerations relating to golf towels that the present invention has evolved.

SUMMARY OF THE INVENTION

One improvement of the present invention relates to enhancing the convenience of retaining a towel on a carrying handle of a golf bag and of using that towel during the play of a golf game. Another improvement relates to retaining a towel on the carrying handle of a golf bag in such a manner that the towel is more resistant to accidental dislodgement caused by moving and carrying of the bag. A further improvement relates to retaining a towel on the carrying handle of a golf bag in such a manner that the carrying handle can still be conveniently grasped and used to lift, carry and position the bag. Still another improvement relates to allowing a larger sized towel to be retained to the carrying handle of a golf bag without creating additional inconvenience in grasping the handle. Yet another improvement, among others, relates to conveniently retaining a towel to the carrying handle of a golf bag without requiring the use of mechanical attachment devices.

To achieve these and other improvements, the present invention involves a towel which is capable of self-retention on a carrying handle of a golf bag. The towel generally comprises a sheet of absorbent material having two panels connected by a bridge. Each of the panels defines a shoulder of the material which faces the other panel opposite a separation extending from the bridge. The bridge is adapted to extend through the carrying handle and to suspend a substantial majority of the panels below the carrying handle with the shoulder of each panel contacting an opposite side of the carrying handle. The shoulders and the suspended substantial majority of the panels located on opposite sides of the handle resist removal of the towel from within the handle. The bridge avoids accumulating all of the sheet material in the handle and thereby exposes the handle for convenient grasping.

Preferred aspects of the invention include the following. No mechanical devices are required to hold the towel to the handle or to connect or disconnect it when the towel is removed and replaced. The panels and the shoulders are approximately the same size. The bridge and the panels are integrally formed of the absorbent material of the sheet.

The sheet defines a separation extending from the bridge to at least one edge of the sheet. The separation extends from an edge into the middle region of the sheet. The shoulders of each panel are adjacent to the separation. To prevent tearing, the material in the bridge and in the panels surrounding the end of the separation is reinforced. The towel material along each edge of the separation is also reinforced to prevent separation or unraveling.

Another improvement of the present invention involves a method of retaining two towel panels to a carrying handle of a golf bag. The method involves connecting the towel panels by a bridging element of a size smaller than each of the panels. Once the towel panels are connected, one of the panels and a portion of the bridging element are extended through the carrying handle. The panels are suspended on opposite sides of the handle from the bridging element which extends through the handle. Preferably, the two panels are joined to form the bridging element in such a manner as to form oppositely facing shoulders extending from the bridging element. The shoulders contact opposite sides of the carrying handle. The golf towel may be slit into its middle region to define the two oppositely facing retaining shoulders and bridge element. The golf towel is then placed through the handle with the two retaining shoulders on opposite sides of the handle to contact the handle on opposite sides for substantially retaining the towel to the handle and preventing accidental removal of the towel from within the handle.

A more complete appreciation of the present invention and its scope can be obtained by reference to the accompanying drawings, which are briefly summarized below, to the following detailed description of presently preferred embodiments of the invention, and to the appended claims.

DETAILED DESCRIPTION

Figure 1:
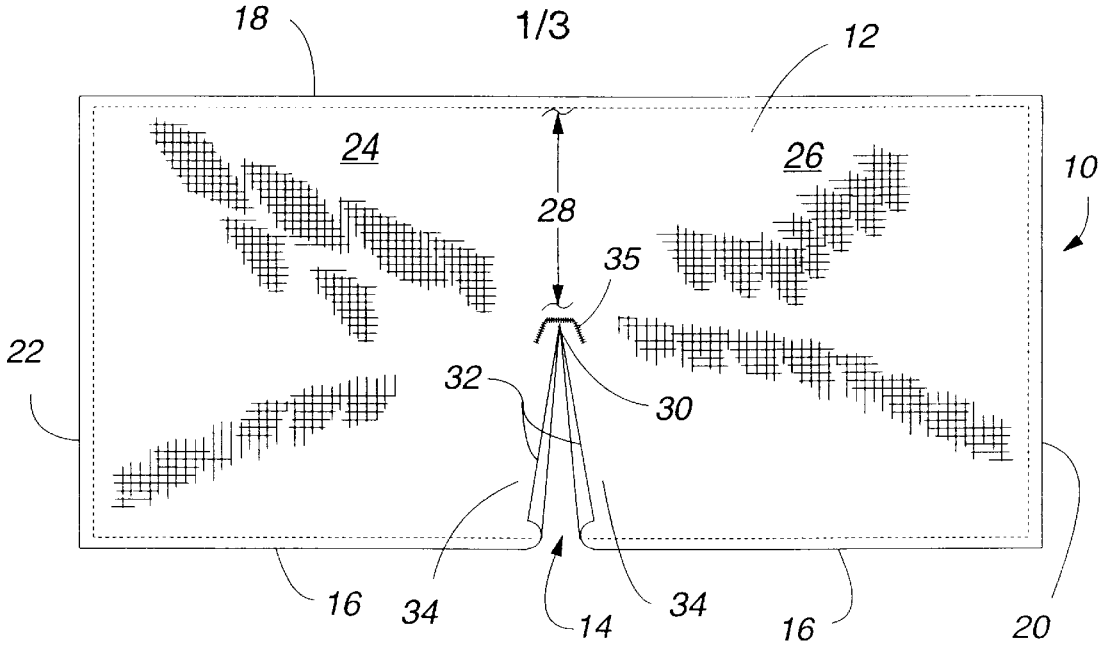
FIG. 1 is a plan view of a towel incorporating the present invention.

A towel 10 incorporating the present invention is shown in FIG. 1. The towel 10 generally comprises a sheet 12 having a slit 14 extending into a middle region of the sheet 12.

Preferably, the sheet 12 is made of liquid absorbent material such as terry cloth or the like and is generally rectangular in shape having two longitudinal edges or sides 16 and 18 and two transverse edges or ends 20 and 22. The slit 14 extends from one longitudinal side 16 toward the other longitudinal side 18 and terminates in a middle region of the sheet 12 short of the side 18. Preferably, the slit 14 terminates about halfway across the sheet 12 between sides 16 and 18, at a location approximately midway from the transverse ends 20 and 22. Other positions and locations of the slit 14 are also possible in accordance with the invention.

The slit 14 essentially divides the sheet 12 into two panels 24 and 26 which are preferably approximately equal in size. The panels 24 and 26 are connected by a bridge of the sheet material extending between an inner terminal end 30 of the slit 14 and the longitudinal side 18. The slit 14 defines two edges 32 of two oppositely facing shoulders 34. The shoulders 34 generally comprise the material adjacent the edges 32.

The edges 32 defined by the slit 14 are preferably hemmed, stitched or otherwise treated in some manner so that the sheet 12 will not unravel along these edges 32. The material around the terminal inner end 30 of the slit 14 is also preferably stitched or otherwise reinforced in some manner (as shown at 35) to prevent tearing of the sheet 12 from the end 30 of the slit 14.

Figure 2:
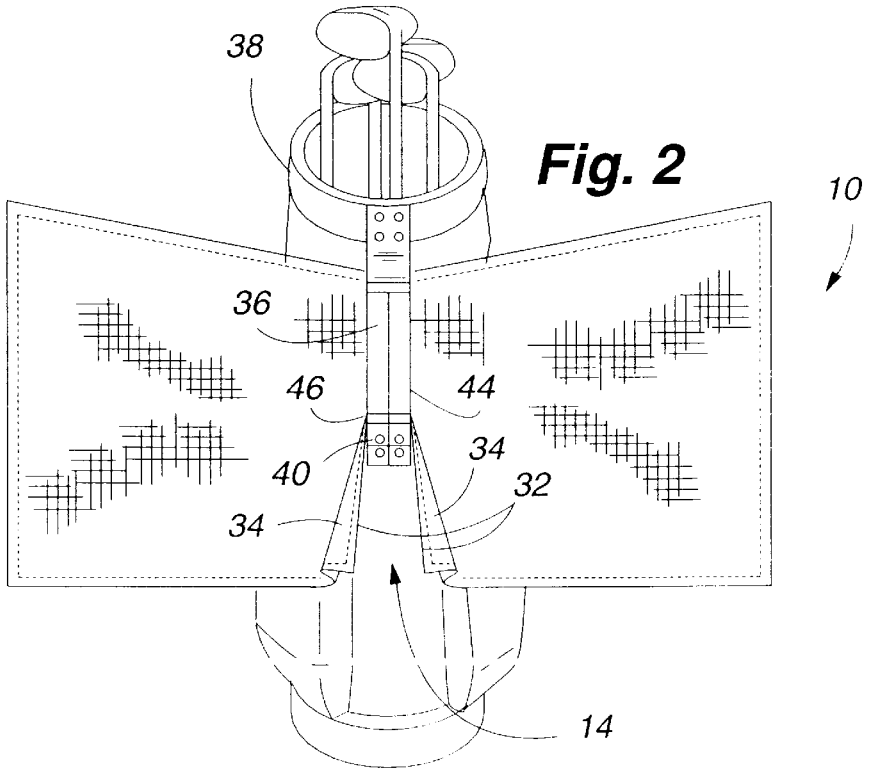
FIG. 2 is a perspective view of the towel shown in FIG. 1 positioned through a golf-bag carrying handle with the towel shown in a fully extended position.
Figure 3:
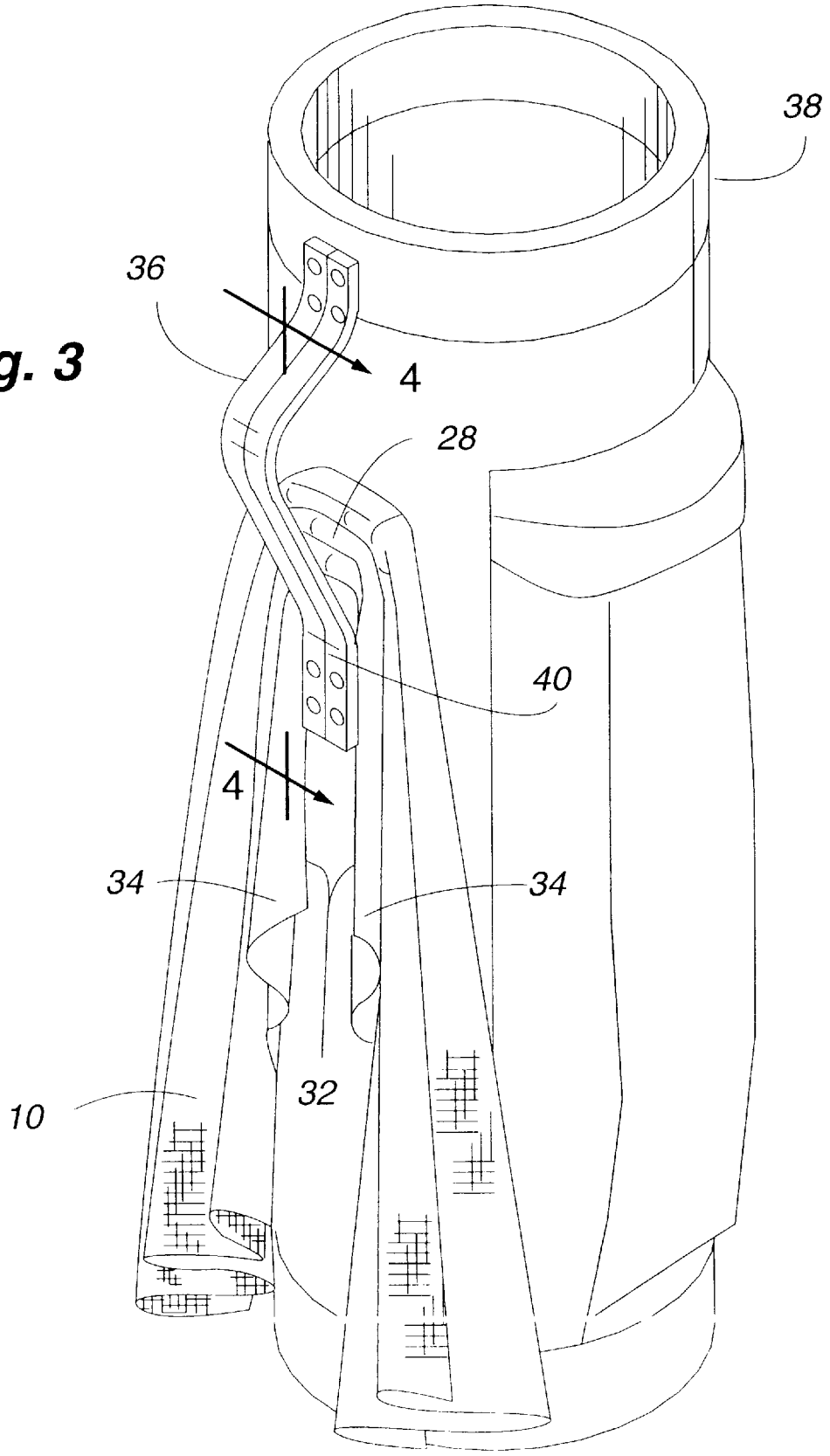
FIG. 3 is an enlarged perspective view of the towel and golf bag shown in FIG. 2, with the towel shown hanging downward from the golf-bag handle.
Figure 4:
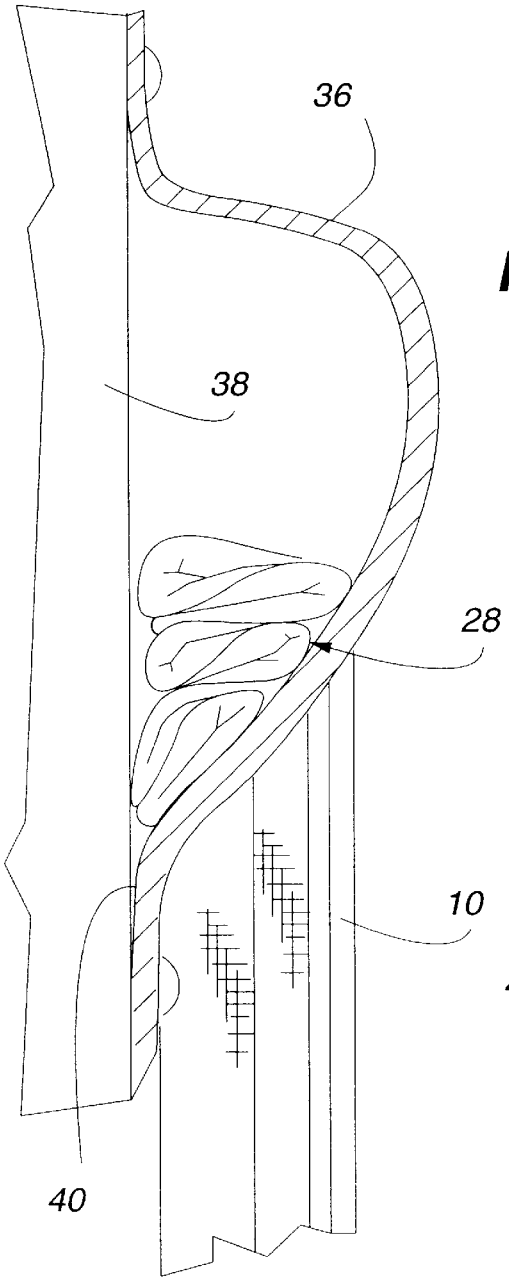
FIG. 4 is a partial cross-sectional view of the towel and golf bag shown in FIG. 3 taken substantially in the plane of line 4—4 in FIG. 3.

The shoulders 34 are intended to be placed on opposite sides of a carrying handle 36 located on one side of a golf bag 38 as shown in FIG. 2, after the towel 10 is inserted through the handle 36. Once in place, the end 30 of the slit 14 rests near a lower portion 40 of the handle 36 where the handle 36 connects to the bag 38, also shown in FIG. 4. When the towel 10 is released from the extended position shown in FIG. 2 and allowed to hang freely downward in the position shown in FIG. 3, each panel 24 and 26 hangs down on an opposite side of the handle 36 from the other panel. In this position, primarily only the bridge material 28 (FIG. 1) is located in the handle 36 as shown in FIGS. 2 and 4. The material 28 (FIG. 4) is approximately one half the amount of material 42 (FIG. 5) that would otherwise be located between the handle 36 and the bag 38 if a prior-art towel 10'

(FIG. 5) not having a slit were placed in the handle 36 and if the slit 14 extends approximately half way across the towel. Reducing the amount of material in the handle 36 in this manner causes more material to hang below the handle 36.

Figure 5:
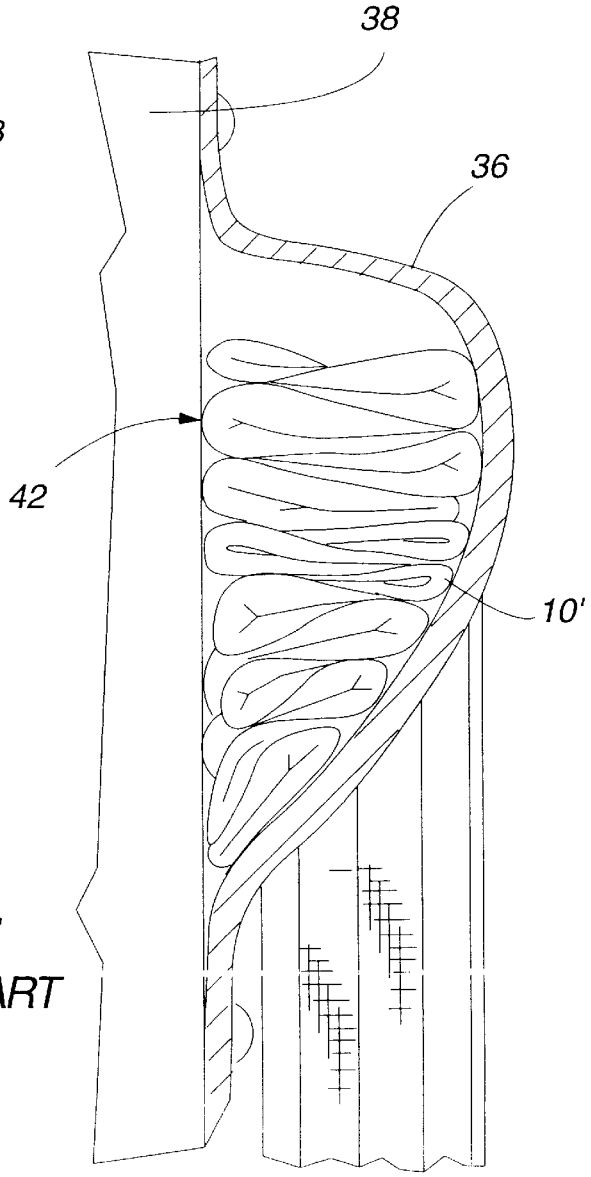
FIG. 5 PRIOR ART
FIG. 5 is a partial cross-sectional view, similar to FIG. 4, of a prior-art towel not incorporating the present invention draped through a golf-bag carrying handle.

Placing the shoulders 34 on opposite sides of the handle 36 prevents the towel 10 from inadvertently slipping through the handle 36 since the material of the shoulders 34 provides added resistance against forces that would otherwise cause the towel to move out of the handle 36 in one direction or the other. As the towel 10 begins to move out of the handle 36 due to gravity or other inadvertent forces, an increasing amount of sheet material forming a panel 24 or 26 (FIG. 1) must be brought through the handle 36 relative to the initial amount of bridge material 28 present in the handle 36, shown in FIG. 4. Indeed, the amount of material normally moving through the handle 36 at a particular point in time may be larger than the amount pulled through the handle 36 if a similar sized towel without the slit 14 were used. If an un-slitted towel 10' were used, as shown in FIG. 5 for example, normal pulling forces would cause relatively equal amounts of material 42 to slide through the handle 36 at all times during the removal process. Since the increasing amount of material associated with the shoulders 34 of the towel 10 of the present invention resists movement through the handle 36, more force is required to pull the towel 10 through the handle 36 than would otherwise be necessary if no shoulders were used. Thus, as the bag 38 is being carried or otherwise moved about, the shoulders 34 of the towel 10 provide self-retention to the handle 36 without using other mechanical devices.

Additionally, the towel 10 is more likely to stay in place on the handle 36 because the slit 14 increases the amount the material located below the handle 36 compared with a prior-art towel 10' (FIG. 5). Increasing the amount of material below the handle 36 generally lowers the center of gravity associated with each panel 24 and 26 on each side of the handle 36. Lowering the center of gravity makes the each panel 24 or 26 less likely to inadvertently move through the handle 36 since an additional amount of force is required to lift the panel through the handle 36 and overcome the relatively lower center of gravity. As the bag is being carried, the forces acting on the towel are generally not in the upward direction since the golf bag should be carried in a manner that prevents the clubs from falling out. Therefore, the lower center of gravity provides increased self-retention as the bag is being carried or moved about on a golf cart because the gravitational forces will naturally provide a downward force component and help retain the towel 10 in the handle 36.

The edges 32 also aid in retaining the towel 10 in the handle 36 because they often abut the handle 36 creating additional resistance against movement. At times, the towel 10 will slide to one side or the other such that the end 30 of the slit 14 is positioned adjacent either the right side 44 or the left side 46 of the handle 36 as shown in FIG. 2. In either position, the entire length of one edge 32 is outside the handle 36 while a portion of the other edge 32 is inside the handle 36. The edge 32 located outside the handle 36 abuts the handle 36 causing increased resistance against movement of that edge 32 into the handle 36. Similarly, the inside edge 32 abuts the inside of the handle 36 and causes increased resistance against a downward force on the towel 10. Therefore, the edges 32 provide added resistance against inadvertent dislodgement of the towel 10 as the bag is being carried or otherwise moved about.

Besides providing self-retention, the slit 14 in the sheet 12 also ensures that the shoulder material 34 does not accumulate to such an extent between the handle 36 and the golf bag 38 that an inadequate or overly-restricting space exists for grasping the handle 36, as shown in FIGS. 4 and 5. Without the slit 14 in the golf towel 10, i.e., the prior-art golf towel 10', full width-wise accumulation 42 of material exists between the handle 36 and the golf bag 38, as shown in FIG. 5. The full width of accumulated material 42 significantly reduces the amount of space for grasping the handle 36 and may even prevent the golfer from being able to adequately and conveniently grip the handle 36. On the other hand, the slit 14 of the towel 10 of the present invention causes only the reduced material of the bridge 28 (FIG. 1) to accumulate in the handle. Thus, considerably more space is available between the handle 36 and the bag 38 for grasping the handle 36 with the present invention. Indeed, the slit 14 allows for the use of a relatively larger towel 10 without undue accumulation of material in the handle 36.

The shoulders 34, while large enough to provide sufficient retaining ability during natural movement of the carried golf bag during a round of golf, are not too large to allow for rather convenient and straightforward placement into and removal from the handle 36 when necessary. The golfer may remove the towel 10 by lifting one panel and shoulder 34 up to the level of the handle 36 and pulling the towel 10 in a upward and lateral manner. The lateral force required may be greater than would normally be required with a smaller towel since more fabric is being pulled through a similar space but the additional force does not unduly restrict the removal of the towel 10.

As may be appreciated, the towel 10 may range in size and shape yet still incorporate the benefits of the present invention. The towel 10, however, should be large enough to be able to form shoulders 34 that prevent inadvertent dislodgement of the towel 10. Additionally, the slit 14 can be different lengths, as long as the slit 14, in combination with the size of the towel 10 creates shoulders 34 of adequate size in relation to the material 28. Moreover, the integral bridge material 28 should not be so small that towel 10 has a tendency to rip or tear even when reinforced (at 35, FIG. 1) around the end 30 of the slit 14.

The slit 14 may also comprise various shapes. In place of the parallel edges 32 of the slit 14 which are shown in FIG. 1, a "V-shaped" portion of fabric may be cut from the sheet 12 to create the shoulders 34. The end 30 of the slit 14 can also be of different shapes, such as square or round. Indeed, shaping the end 30 of the slit 14 to conform with various golf-bag handles may actually disperse the concentration of forces that might potentially rip the end 30 of the slit 14 and help with retention. Additionally, a squared end (not shown) may provide additional resistance to movement because it would provide an additional edge that abuts the handle 36, resisting movement in the down direction.

Incorporating the slit 14 into the towel 10 allows for the use of a relatively larger sheet 12 of absorbent material while avoiding the normal drawbacks of larger prior-art golf towels. Since the towel 10 will be draped through the handle 36, the towel 10 does not hang down as far as if it were attached to the golf bag 36 from one end of the towel 10, thus substantially reducing the probability that the towel will drag. Additionally, the large towel 10 does not substantially consume the space between the handle 36 and the bag 38 so the golfer can adequately grip the handle 36. Draping the towel 10 through the handle 36 of the golf bag 38 does not require the use of any special clips, ties or other mechanical devices but remains relatively secure in the handle 36 while the bag 38 is being carried.

The numerous advantages and improvements from the present invention have been described. A presently preferred embodiment of the present invention has been described with a degree of particularity. This description is of a preferred example of implementing the invention, and is not necessarily intended to limit the scope of the invention. The scope of the invention is defined by the following claims.

What is claimed is:

1. A self retaining towel in combination with a golf bag having a carrying handle, said towel comprising:

a sheet of absorbent material comprising two panels connected at a bridge extending between the panels;

each of the panels defining a shoulder of the material facing the other panel on opposite sides of a separation extending from the bridge, and the bridge extending through the carrying handle and suspending a substantial majority of the panels below the carrying handle with the shoulder of each panel contacting an opposite side of the carrying handle, the shoulders and the suspended substantial majority of the panels on opposite sides of the handle resisting removal of the towel from within the handle.

2. An invention as defined in claim 1 wherein the panels are approximately the same size.

3. An invention as defined in claim 2 wherein each shoulder is approximately the same size.

4. An invention defined in claim 1 wherein the bridge is formed of the absorbent material from which the panels are formed.

5. An invention as defined in claim 1 wherein the bridge and the panels are integrally formed of the absorbent material of the sheet.

6. An invention as defined in claim 5 wherein the bridge connects the panels.

7. An invention as defined in claim 6 wherein the sheet of material defines the separation extending from the bridge to at least one edge of the sheet.

8. An invention as defined in claim 7 wherein the shoulders of each panel are adjacent to the separation.

9. An invention as defined in claim 7 wherein the separation extends approximately half of a transverse distance across the sheet.

10. An invention as defined in claim 9 wherein the bridge extends approximately the remaining transverse distance across the sheet.

11. An invention as defined in claim 7 further comprising a reinforcement in the material in the bridge and in the panels surrounding a terminal inner end of the separation to inhibit separation of the material in the bridge.

12. An invention as defined in claim 7 further comprising a reinforcement in the material on each edge of the separation to inhibit separation of the material at each edge and within each shoulder.

13. An invention as defined in claim 7 wherein the separation extends in a substantially straight line from the bridge to the at least one edge of the sheet.

14. An invention as defined in claim 1 wherein:

the sheet is substantially rectangular;

the substantially rectangular sheet defines two longitudinal edges and two transverse edges;

the separation extends from one longitudinal edge to an inner terminal end located in a middle area of the sheet;

the bridge extends from the inner terminal end of the separation to the longitudinal edge opposite the longitudinal edge from which the separation extends; and the bridge and the panels are integrally formed of the material of the sheet.

15. An invention as defined in claim 14 wherein the inner terminal end of the separation is located approximately midway between the longitudinal edges.

16. An invention as defined in claim 15 wherein each panel is approximately equal in size and shape.

17. An invention as defined in claim 14 wherein the longitudinal edges are longer than the transverse edges.

18. A self retaining towel in combination with a golf bag having a carrying handle, said towel comprising:

a sheet of absorbent material divided by a slit extending from one side of the sheet into a middle area of the sheet;

the slit terminating short of an opposite side of the sheet to define a bridge of the sheet material between an innermost terminal end of the slit and the opposite side of the sheet;

the slit defining panels on opposite sides of the slit and the bridge; and the bridge contacting the carrying handle and suspending a substantial majority of the panels below the carrying handle on opposite sides of the carrying handle to resist removal of the towel from within the handle.

19. An invention as defined in claim 18 wherein:

the sheet of material is substantially rectangular;

the substantially rectangular sheet defines two longitudinal edges and two transverse edges;

the one side comprises one longitudinal edge and the opposite side comprises the other longitudinal edge; and the longitudinal edges are longer than the transverse edges.

20. An invention as defined in claim 18 wherein the panels are approximately the same size.

21. An invention as defined in claim 18 wherein the slit terminates approximately halfway between the one side of the sheet and the opposite side of the sheet.

22. An invention as defined in claim 18 further comprising a reinforcement in the material surrounding the innermost terminal end of the slit to inhibit separation of the material in the bridge.

23. An invention as defined in claim 18 wherein the slit extends in a substantially straight line.

24. A method of retaining two towel panels from within a carrying handle of a golf bag in a manner which inhibits unintended withdrawal of the towel panels from within the carrying handle during normal use of the golf bag while still providing adequate access to the handle for manual carrying of the golf bag while the towel panels are retained from within the carrying handle, said method comprising the steps of:

connecting the towel panels by a bridging element of a size smaller than each of the panels;

extending one of the panels and a portion of the bridging element through the carrying handle; and locating the bridging element within the carrying handle at a lower location where the carrying handle joins the golf bag to suspend the substantial majority of the panels from the bridging element below and on opposite sides of the handle from the location where the bridging element extends through the handle and to allow access to the carrying handle above the bridging element for manually carrying the golf bag.

25. A method as defined in claim 24 further comprising the steps of:

joining the two panels to form the bridging element at the location where the two panels are joined;

joining the two panels to form oppositely facing shoulders extending from the bridging element; and contacting portions of the shoulder of each panel adjacent to the bridging element with opposite sides of the carrying handle.

26. A method as defined in claim 25 further comprising the step of:

reinforcing the bridging element and the two panels at the location where the panels are joined.

27. A method as defined in claim 25 further comprising the steps of:

reinforcing the material at the shoulder of each panel.

28. A method of retaining a towel from within a carrying handle of a golf bag in a manner which inhibits unintended withdrawal of the towel from within the carrying handle during normal use of the golf bag while still providing adequate access to the handle for manual carrying of the golf bag while the towel is retained from within the carrying handle, said method comprising:

slitting the towel into its middle region to an inner terminal end to define two oppositely facing retaining shoulders;

placing the towel within the handle the two retaining shoulders on opposite sides of the handle;

contacting the inner terminal end of the slit with the handle at a lower location where the carrying handle joins the golf bag;

contacting portions of shoulders at the inner terminal end of the slit with opposite sides of the handle;

retaining the towel within the handle by suspending the substantial majority of the towel on opposite sides of the handle below the location where the carrying handle joins the golf bag to allow access to the carrying handle above the location where the towel is retained for manually carrying the golf bag by the handle.

29. A method as defined in claim 28 further comprising the steps of:

slitting the towel to define the towel into two approximately equally sized and shaped panels on opposite sides of the slit.

30. A method as defined in claim 28 further comprising the step of:

reinforcing the middle region of the towel near the slit.

31. A method as defined in claim 28 wherein the towel is substantially rectangular in shape, the substantially rectangular towel defines two long edges and two short edges, and wherein the slitting step further comprises slitting the towel from one long edge toward the other long edge.

* * * * *